United States Patent [19]

Sowell

[11] Patent Number: 4,880,227

[45] Date of Patent: Nov. 14, 1989

[54] VARIABLE EXERCISER

[76] Inventor: Wendell L. Sowell, 4414 Brush Hill Rd., Nashville, Tenn. 37216

[21] Appl. No.: 283,088

[22] Filed: Dec. 12, 1988

[51] Int. Cl.[4] ..... A63B 21/06

[52] U.S. Cl. ..... 272/118; 272/73; 272/130; 272/132; 272/134

[58] Field of Search ..... 272/117, 118, 130, 132, 272/134, 72, 73

[56] References Cited

U.S. PATENT DOCUMENTS

| | | | |
|---|---|---|---|
| 3,017,180 | 1/1962 | Aronsohn | 272/134 X |
| 3,127,171 | 3/1964 | Noland et al. | 272/117 |
| 3,540,435 | 11/1970 | Smith | 272/134 X |
| 3,743,282 | 7/1973 | Zinkin | 272/118 |
| 3,850,431 | 11/1974 | Winans | 272/118 |
| 3,918,710 | 11/1975 | Niebojewski | 272/134 X |
| 4,275,882 | 6/1981 | Grosser et al. | 272/130 X |
| 4,624,457 | 11/1986 | Silberman et al. | 272/118 |

*Primary Examiner*—Richard J. Apley
*Assistant Examiner*—Robert W. Bahr
*Attorney, Agent, or Firm*—Harrington A. Lackey

[57] ABSTRACT

An exercise apparatus having an upright support frame upon which is mounted an adjustably weighted pull cable, an exercise lever, a rotary hand crank assembly and a rotary pedal crank assembly, all spaced within reach of a person seated or standing in front of the upright support frame in a user station. The user station is particularly adapted to receive a detachable seat member for the user, or when detached, permits the reception of a conventional chair or wheelchair in which the user may sit to operate any one or all of the exercise devices on the upright support frame.

11 Claims, 4 Drawing Sheets

VARIABLE EXERCISER

BACKGROUND OF THE INVENTION

This invention relates to an exercise apparatus, and more particularly to an exercise apparatus in which the exercise devices are within the convenient reach of a user at a single operator station.

Exercise apparatus of numerous designs are well known in the art.

Various types of exercise apparatus including pull cables having adjustable weights are well known in the art. Moreover, various types of pedal-operated exercise devices are also known.

Furthermore, various types of collections of exercise apparatus, such as the "Nautilus" machines, in which the limbs of the body are moved in various patterns against adjustable weighted cables, are on the market.

Other exercise apparatus are disclosed in the following U.S. patents:

| | | |
|---|---|---|
| 2,777,439 | Tuttle | Jan. 15, 1957 |
| 3,127,171 | Noland et al | Mar. 31, 1964 |
| 3,848,870 | Craig | Nov. 19, 1974 |
| 3,874,657 | Niebojewski | Apr. 1, 1975 |
| 4,275,882 | Grosser et al | June 30, 1981 |
| 4,316,609 | Silberman | Feb. 23, 1982 |
| 4,564,194 | Dawson | Jan. 14, 1986 |
| 4,603,855 | Sebelle | Aug. 5, 1986 |
| 4,645,205 | Wolff | Feb. 24, 1987 |
| 4,667,955 | Giesch | May 26, 1987 |

Noland et al, FIG. 3 of Niebojewski, Silberman, FIG. 15 of Dawson, and Sebelle disclose various types of adjustable weighted pull cables.

Noland et al, Craig, and FIGS. 10 and 11 of Niebojewski disclose crank assemblies or pedal-operated exercise devices.

The Noland et al patent discloses an exercise apparatus incorporating both an adjustable weighted pull cable and a brake-retarded pedal crank assembly.

Grosser et al, Wolff, and Giesch disclose exercise levers adapted to be pivoted against the action of a double-acting hydraulic piston-cylinder.

None of the above patents disclose an upright frame member incorporating an overhead adjustably weighted pull cable, a resistive actuated exercise lever and a pair of crank assemblies, one for use by the hands, and the other by the feet, all located on a single upright support frame within reach of the operator seated in one location in front of the frame.

SUMMARY OF THE INVENTION

The exercise apparatus made in accordance with this invention includes a frame supporting several exerciser devices capable of exercising most of the muscles in the legs, arms and torso of the operator from a single user or operator station.

Furthermore, the exercise apparatus made in accordance with this invention includes a number of exercise devices mounted on a frame easily accessible to all of the limbs of the operator from a single user station in front of the frame, particularly in a seated position.

Furthermore, the exercise apparatus made in accordance with this invention is particularly adapted for use by a person seated either on a detachable seat member in front of the frame supporting the exercise devices, or in a wheelchair or straight-back chair received in the seat station in front of the apparatus.

A further object of this invention is to provide an exercise apparatus capable of being used either by a standing person or a seated person, in which the operator in a seated position can straddle the upright frame supporting three or four exercise devices mounted symmetrically about the vertical medial plane of the support frame.

A further object of this invention is to provide an exercise apparatus particularly adapted for a seated operator, which renders the apparatus particularly available to invalids, the elderly, and convalescent patients, as well as for healthy persons.

Another object of this invention is to provide an exercise apparatus incorporating various exercise devices for exercising the arms and for exercising the legs in which the arms and legs may be exercised simultaneously.

DESCRIPTION OF THE PREFERRED EMBODIMENTS

Figure 6:
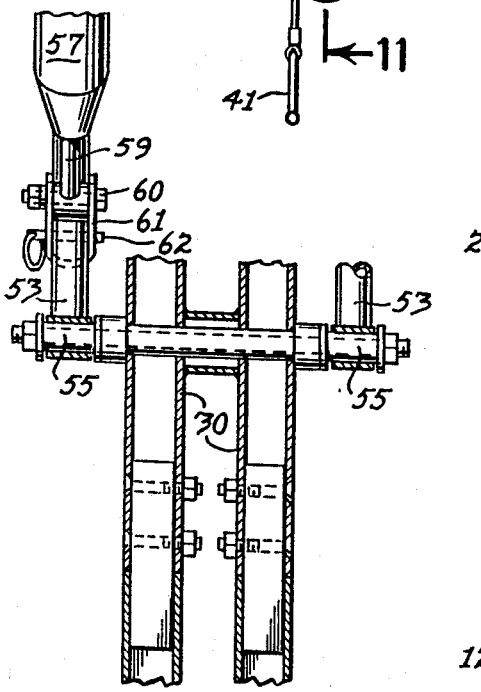
FIG. 6 is an enlarged fragmentary section taken along the line 6—6 of FIG. 1.

Referring now to the drawings in more detail, the exercise apparatus 10 made in accordance with this invention includes a generally rectangular base frame 11 adapted to rest upon a floor F. The base frame 11 supports medially an upright support frame 12 upon which is mounted a variable weighted pull cable device or mechanism 13, an exercise lever 14, an upper hand-operated crank assembly 15 and a lower pedal-operated crank assembly 16. Located in front of the upright support frame 12 and above the base frame 11 is a seat station 18.

Figure 4:
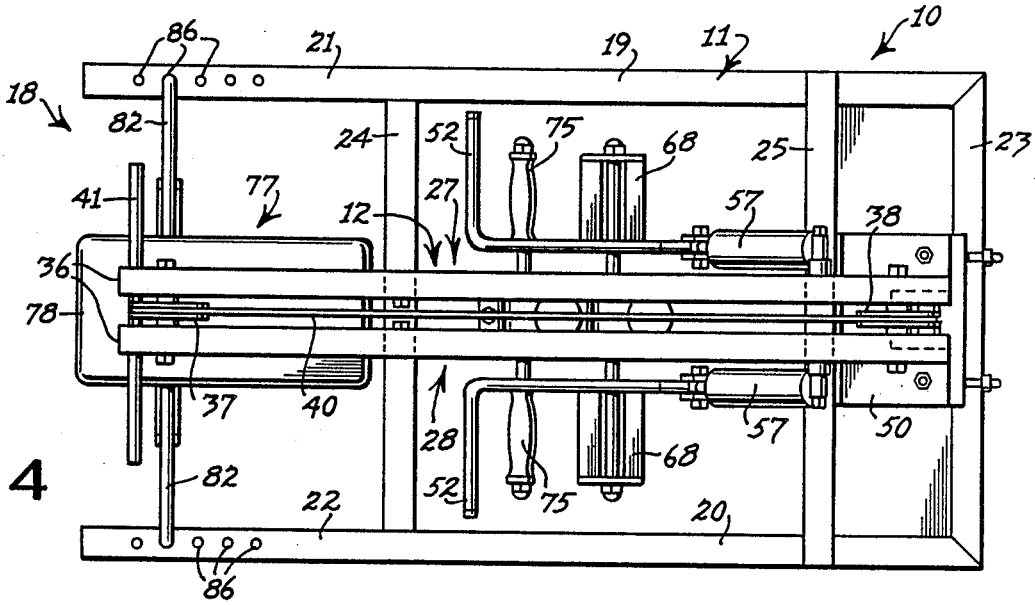
FIG. 4 is a top plan view of the apparatus disclosed in FIG. 1.
Figure 7:
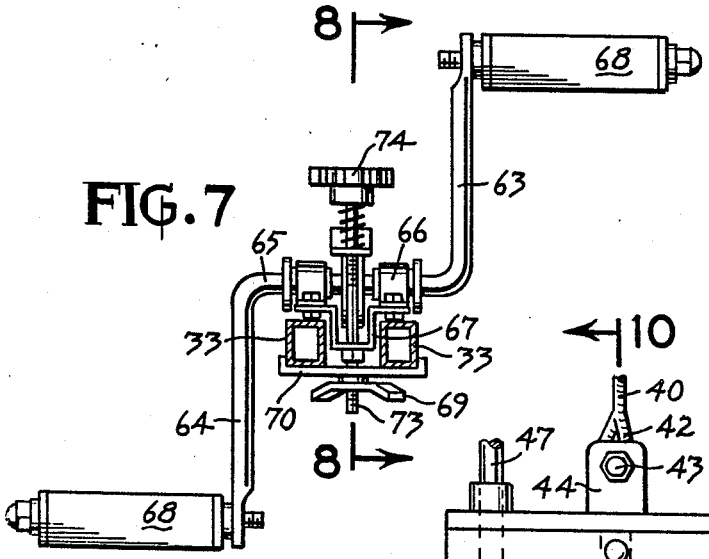
FIG. 7 is an enlarged section taken along the line 7—7 of FIG. 1.
Figure 8:
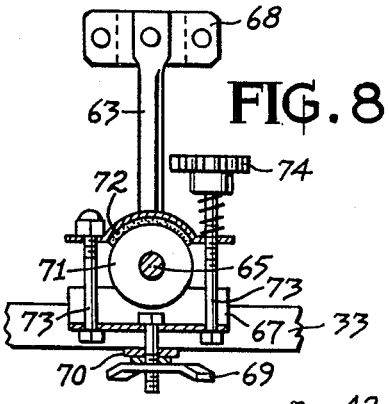
FIG. 8 is a fragmentary section taken along the line 8—8 of FIG. 7.
Figure 9:
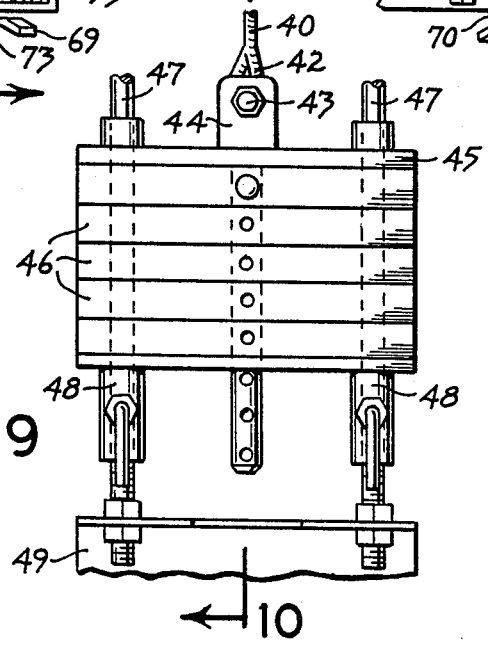
FIG. 9 is an enlarged fragmentary rear elevational view taken along the line 9—9 of FIG. 1.
Figure 10:
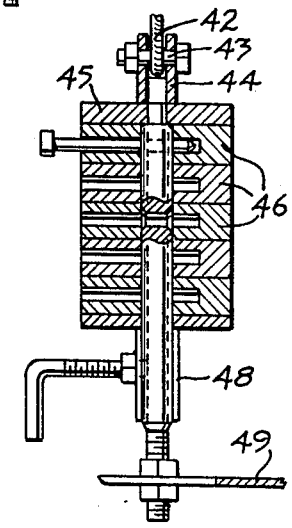
FIG. 10 is a fragmentary section taken along the line 10—10 of FIG. 9.

As best disclosed in FIG. 4, the base frame 11 includes a pair of elongated side frame members 19 and 20 which project forward beyond the front of the upright support frame 12 to provide a pair of transversely spaced forward side frame extension members 21 and 22 to provide a space for receiving a seat or chair. The side frame members 19 and 20 are rigidly held together by the rear transverse bar 23 and the front transverse bar 24.

The relatively narrow upright support frame 12 is rigidly affixed to the base frame 11 by means of the rear transverse A-frame 25.

The upright support frame 12 includes a pair of upright parallel substantially rectangular open frames 27 and 28. Each of the open frames 27 and 28 is spaced apart on opposite sides of the medial plane of the upright support frame 12 coincident with the section line 5—5 of FIG. 2. Each of the open frames 27 and 28 includes a vertical front column or post 29 and a rear column or post 30. Extending front-to-rear and connecting the respective front and rear posts 29 and 30 is an upper longitudinal bar 31, an intermediate longitudinal bar 32 and a lower longitudinal bar 33.

The front and rear posts 29 and 30 and the longitudinal frame bars 31-33 in the spaced open frames 27 and 28 are transversely separated and connected by spacer members 34.

Figure 1:
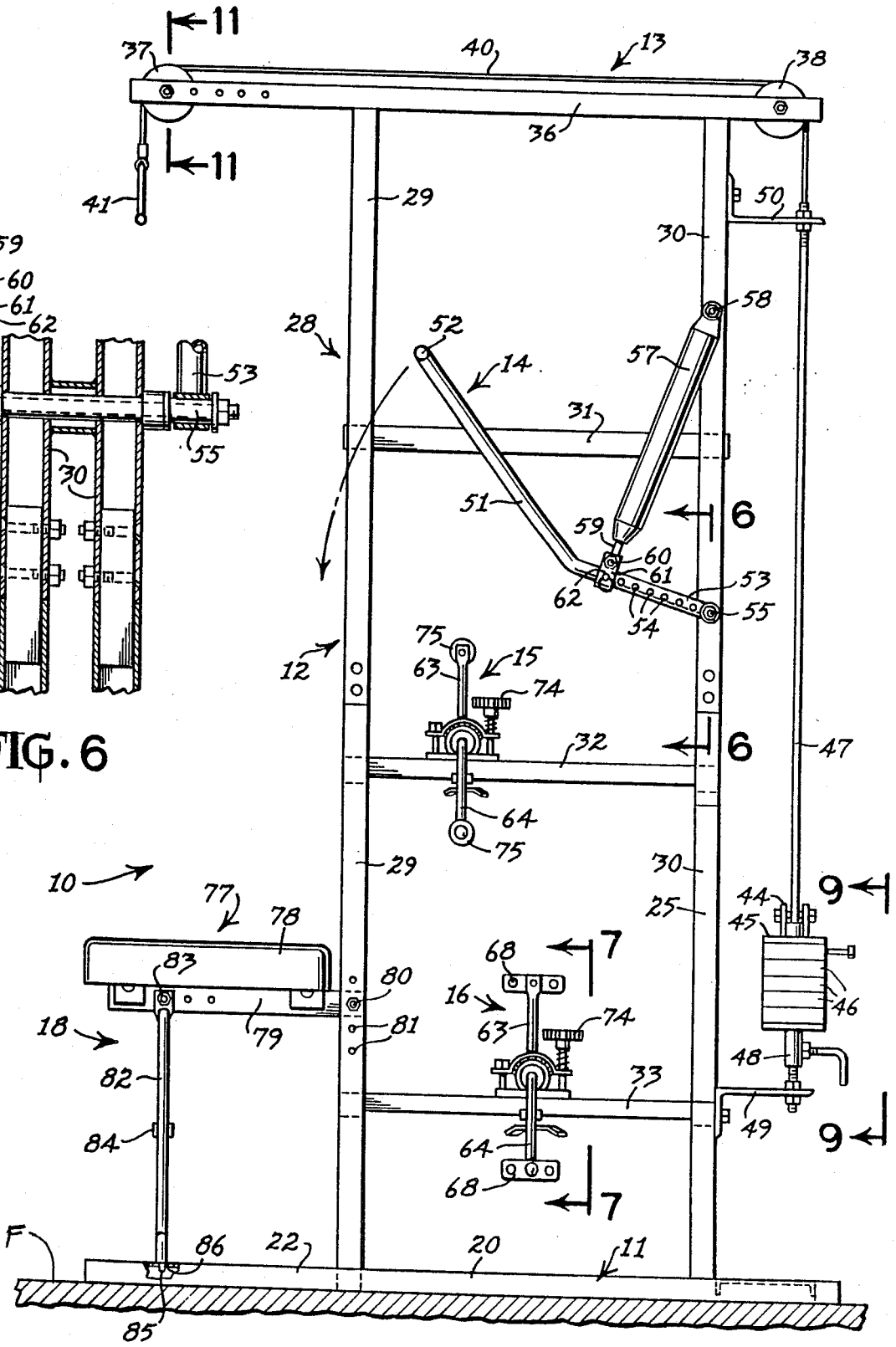
FIG. 1 is a side elevational view of the apparatus made in accordance with this invention.
Figures 5, 11:
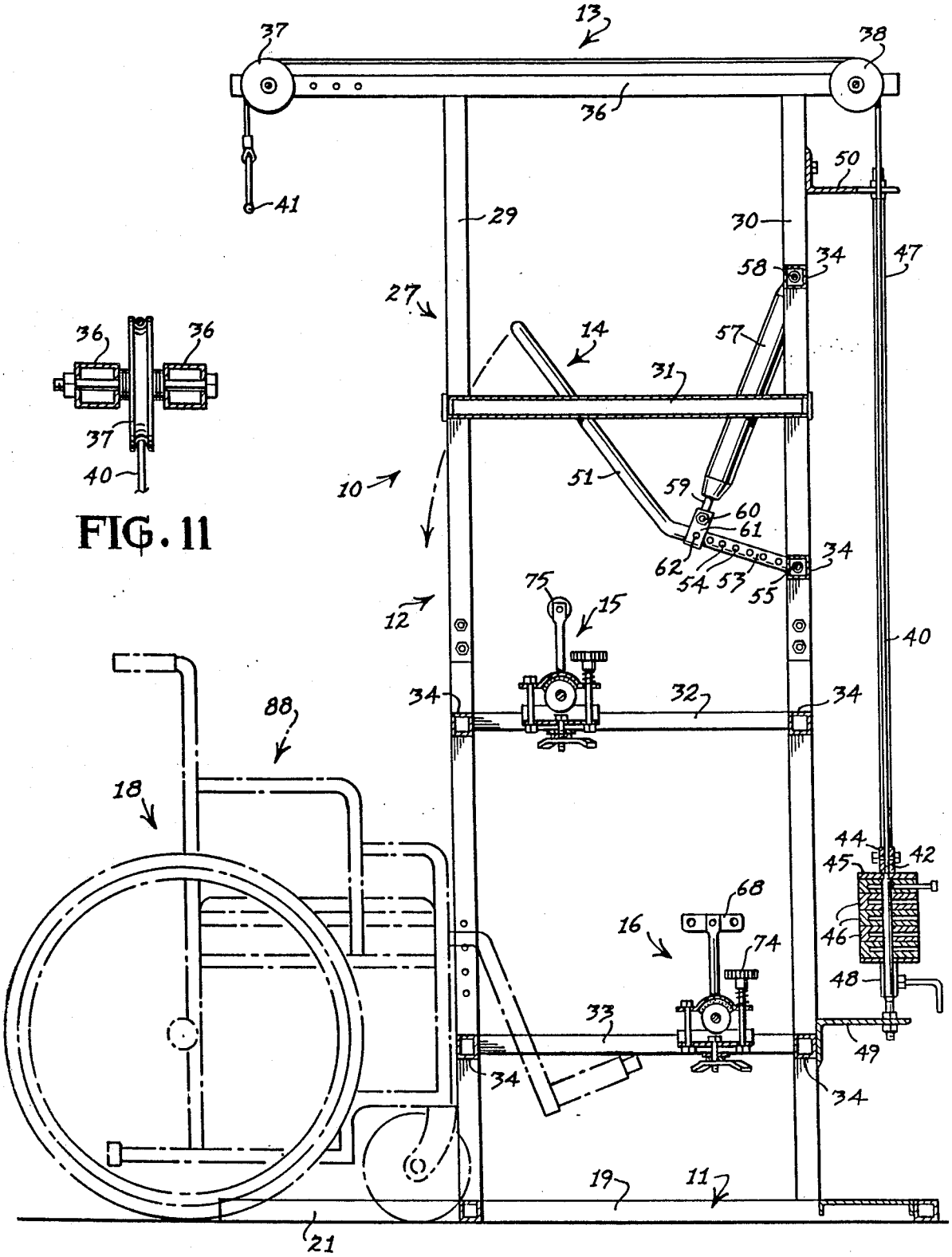
FIG. 5 is a sectional elevation taken along the medial plane line 5—5 of FIG. 2.
FIG. 11 is an enlarged fragmentary section taken along the line 11—11 of FIG. 1.

The upper ends of the front and rear posts 29 and 30 are connected by a pair of parallel longitudinal top bars 36 projecting rearwardly of the corresponding rear posts 30 and substantially forward of the front posts 29, as best disclosed in FIGS. 1 and 5.

The pull cable mechanism 13 includes a front pulley 37 journaled about a transverse horizontal axis between the front portions of the top bars 36, and a rear pulley 38 journaled about a transverse axis between the rear end portions of the top bars 36, as best illustrated in FIGS. 1 and 5. Trained for movement over the pulleys 37 and 38, as they freely rotate, is an elongated cable 40 having its front end terminating in a cable handle 41. The rear portion of the cable 40 projects downwardly from the pulley 38 until its lower end terminates in a loop 42 surrounding the transverse pin 43 in a bracket 44 fixed to the top of a weight frame or cage 45. A plurality of vertically stacked weights 46 of either different or the same values are mounted on the frame 45. The structure of the weight frame 45 and weights 46 is conventional for weight frames in exercising machines.

The weight frame 45 and weights 46 have vertically aligned openings adjacent their opposite ends for receiving fixed guide rods 47 in order to guide the frame 45 and the weights 46 during their vertical travel with the movement of the cable 40. Adjustably mounted stop collars 48 may be fixed in various positions upon the guide rods 47 in order to determine the initial location of the weights 46, as well as the vertical position of the cable handle 41. The bottoms of the guide rods 47 are secured to the bracket 49 fixed to the rear end portion of the upright support frame 12, and the upper ends of the guide rods 47 are fixed to the bracket 50 also fixedly secured to the upper end portions of the rear of the support frame 12, and specifically to the rear posts 30.

Figure 2:
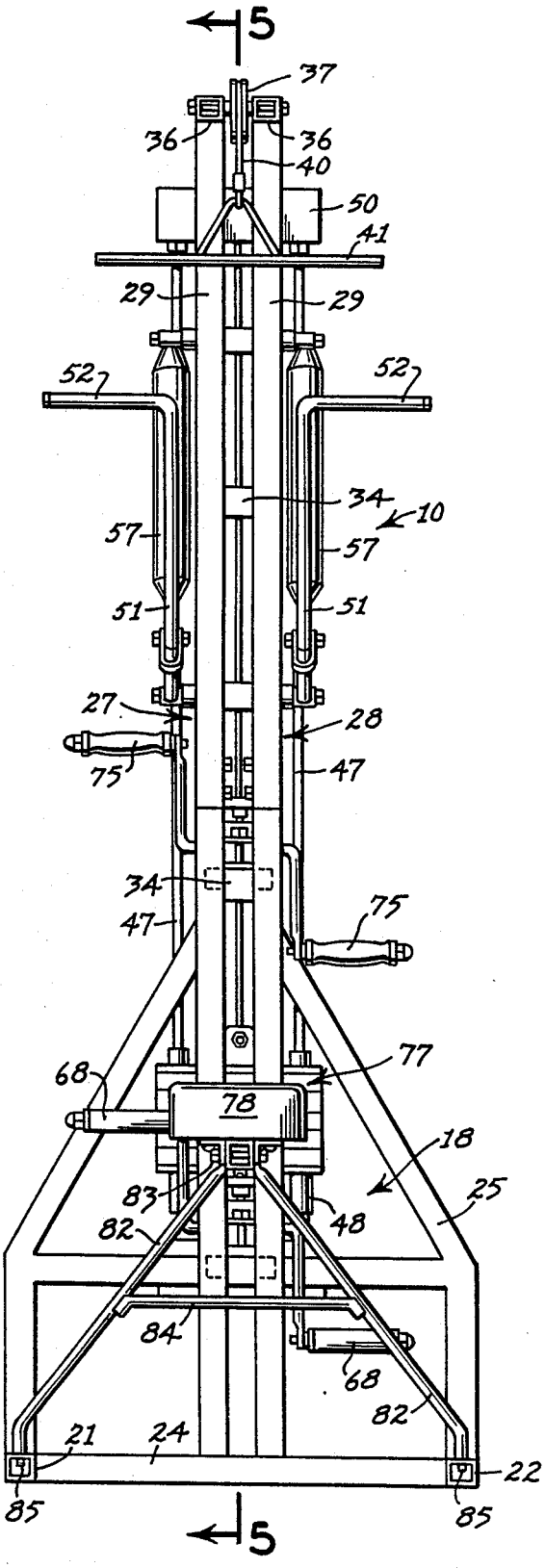
FIG. 2 is a front elevational view of the apparatus disclosed in FIG. 1.
Figure 3:
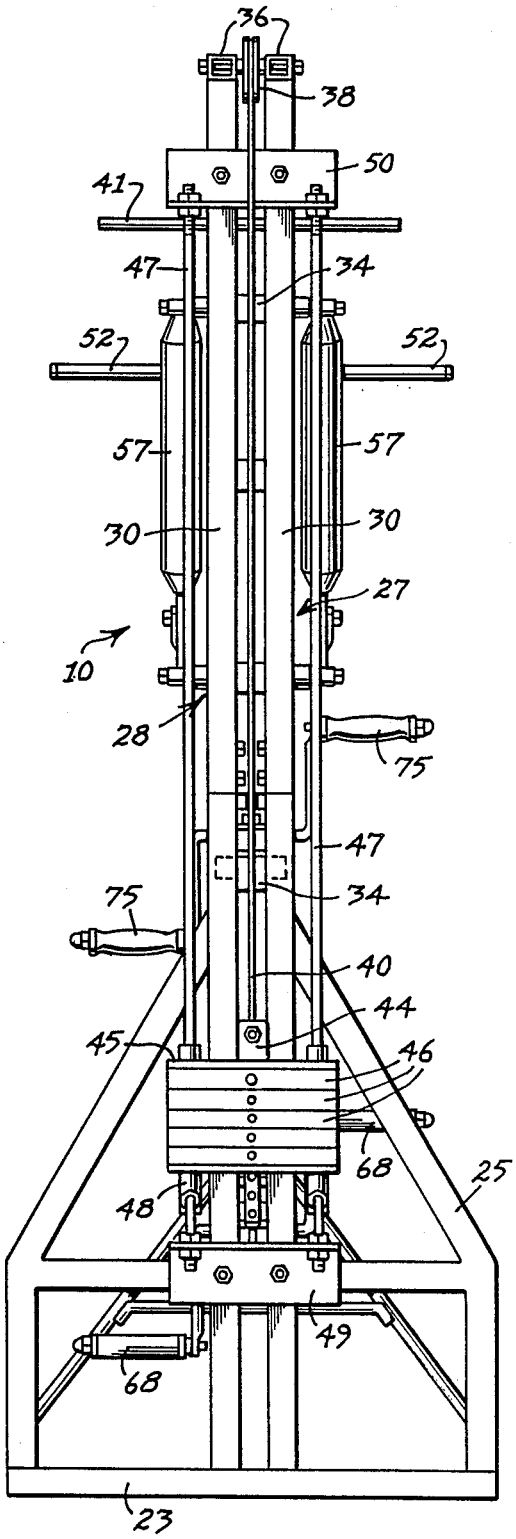
FIG. 3 is a rear elevational view of the apparatus disclosed in FIG. 1.

The exercise lever device 14 includes a pair of elongated levers 51 having out-turned lever handles 52 (FIGS. 2 and 3). Each of the levers 51 is bent to form a rear portion 53 having a plurality of longitudinally spaced apertures 54. The rear end portions 53 of both levers 51 are journaled about the transverse pivot pin 55 journaled between the pair of upright rear posts 30.

A resistive device in the form of an elongated fluid or hydraulic cylinder 57 for each lever 51 is journaled at its upper end by a transverse pivot shaft 58 spanning both upright rear posts 30. A piston rod 59 telescopingly received within each cylinder 57 and cooperating with the interior of the fluid-filled cylinder 57 in the manner of a dash-pot, is connected by a pivot pin 60 to a corresponding bracket 61, which in turn is adjustably secured to one of the apertures through a connector pin 62. Accordingly, the relationship between the resistive cylinder 57 and its corresponding lever arm 51 may be adjusted. Moreover, whenever the lever handle 52 is either pushed or pulled, it will meet with the resistance of the fluid within the cylinder 57 acting upon one surface or the other of the piston fixed to the piston rod 59. The greater the force of the push or pull against the handle bars 52, the greater will be the resistance to the effort of the user of the device 14.

As best disclosed in FIGS. 1, 5, 7, and 8, a lower crank assembly 16 includes a pair of crank arms 63 and 64 connected by a journal rod 65, journaled for rotation in the bearings 66 mounted on a support bracket 67. The crank arms 63 and 64 project in opposite directions and terminate in the conventional pedals 68. The support bracket 67 is designed to be moved longitudinally along both the intermediate bars 32 and clamped in any desired operative position by the wing-nut 69 against the bottom clamp bracket 70 to squeeze the clamp bracket 70 and the support bracket 67 together in engagement with the lower longitudinal bar 33.

The journal rod 65 is fixed to a brake disc or brake drum 71 which is adapted to engage a brake shoe 72 which is supported by the pins 73 connected to the support bracket 67. One of the pins is provided with an adjustable knob 74 threaded into one side of the brake shoe 72 to adjust the friction between the brake shoe 72 and the brake drum 71.

The construction of the upper clamp assembly 15 is identical to the lower clamp assembly 16, except that the pedals 68 are replaced by hand grips 75 at the terminal ends of the crank arms 63 and 64. Thus, all of the elements, except the hand grips 75, in the upper crank assembly 15 have the same reference numerals to the corresponding parts in the lower crank assembly 16.

In the preferred form of the invention, a detachable seat member 77 is located in the seat station 18, as best illustrated in FIGS. 1, 2 and 4. The seat member 77 includes a padded or upholstered seat 78 mounted on an elongated seat bracket or bar 79, the rear end of which is connected to the upright support frame 12 by a transverse pin 80 through transversely aligned pin apertures 81 in the front posts 29. The seat member 77 further includes a pair of downward diverging legs 82 fixed at their upper ends by a transverse pin 83 extending through the opposite sides of the seat bar 79. The legs 82 may be reinforced by the transverse strut 84. The bottom ends of the diverging legs 82 terminate in depending stubs 85 which are adapted to be inserted or slip fitted into corresponding stub apertures or sockets 86 in the tops of the frame extension members 21 and 22. It will be noted that the stub apertures 86 are longitudinally spaced front-to-rear in order to adjustably position the legs 82 relative to the frame extension members 21 and 22.

It will thus be seen that the seat member 77 may be rigidly connected to the upright frame member 12 for operation of the various exercise devices by an invalid or any other user of the apparatus 10. Moreover, the seat member 77 may be easily and quickly removed from the upright support frame 12 by merely removing the pin 80 and lifting the legs 82 to remove the stubs 85 from the stub apertures 86. When the seat member 77 is removed, the station 18 may be utilized by a person who is standing, or by a person seated on another seating device, such as the wheelchair 88, illustrated in FIG. 5. The wheelchair 88 may be rolled into close proximity to the front posts 29 of the upright support frame 12 and between the forward side frame extension members 21 and 22. With the wheelchair 88 in its operative position disclosed in FIG. 5, the occupant of the wheelchair will be in substantially the same position as a person seated on the seat member 77.

Also, instead of the seat member 77 or the wheelchair 88, a conventional stool or straight chair, or any other type of seating device, may be positioned between the frame extension members 21 and 22 closely adjacent the front posts 29.

Regardless of the type of seating device used, whether a seat member 77 or a wheelchair 88, all of the exercising devices 13, 14, 15, and 16, are pre-positioned to be in a convenient location accessible to the person in the seat station 18 so that the user may easily and conveniently operate the respective devices 13, 14, 15, and 16. Since the lower crank assembly 16 is operated by the feet of the user, and the other three devices 13, 14, and 15 are operated by the hands of the user, any one of the devices 13, 14, and 15 may be used at any one time while the feet of the user are propelling the lower crank assembly 16.

The transverse dimension or width of the upright support frame 12 is such that when the operator is in a seated position, both his legs and arms may project along both sides of the upright frame member 12 behind the front posts 29 in order to operate the exercise lever 51, the hand grips 75 and/or the pedals 68.

The transverse dimension between the forward projecting frame extension members 21 and 22 is greater than the wheel base of the wheelchair 88 or the base of any other chair or seating device desired to be positioned between the extension members 21 and 22 within the seat station 18 and closely adjacent the front posts 29. Thus, the downward diverging legs 82 must span a transverse distance approximately equal to the spacing between the frame extension members 21 and 22, and greater than the wheel base of the wheelchair 88 or any other chair to be received within the seat station 18.

It will be seen that all of the exercise devices 13, 14, 15, and 16 mounted on the upright support frame 12 may be adjusted and re-positioned in order to be located comfortably within the reach of the occupant of the seat station 18.

Although in the usual manner of operating the exercising devices 13, 14, 15, and 16, the user is seated in front of and facing the upright support frame 12, the user may stand and face the upright support frame 12 or he may stand with his back to the frame in order to operate the handles 41 of the pull cable device 13, or the exercise lever 51.

Furthermore, it is within the scope of this invention to turn the exercise lever device 14 upside down and locate the transverse pin 55 on the lever rear portion 53 in the upper hole, where the transverse pin 58 is located in the drawings, and to insert the pin 58 through the apertures normally receiving the pin 55. The exercise lever 51 may be moved in either direction against the action of the fluid within the resistive cylinder 57.

It will also be apparent from the drawings, that both upper and lower crank assemblies 15 may be rotated in either rotary direction.

As illustrated in FIGS. 1, 5, and 6, the upright support frame 12 may be constructed of an upper frame section and a lower frame section in which the posts 29 and 30 are detachably bolted together.

It will be seen that the apparatus 10 can be used by anyone who desires to exercise most of the muscles throughout his entire body, including the torso, arms, and legs. However, the apparatus 10 is uniquely adapted for an exercise program for the elderly, the invalid and the convalescent patient. The apparatus 10 can also be used in any relatively confined space, such as a room in a person's home in order to exercise at any time and any weather in order to maintain muscle tone, improve blood circulation, and maintain weight and cholesterol control.

What is claimed is:

1. An exercise apparatus comprising:

(a) a base frame adapted to be supported upon a floor and having front and rear portions, (b) an upright support frame projecting upward from said base frame, (c) a seat station in front of said upright support frame, (d) pulley means mounted on the upper portion of said upright support frame, (e) a cable supported for movement over said pulley means and having front and rear ends on opposite sides of said pulley means, (f) a cable handle on the front end of said cable above said seat station, (g) detachable weight means mounted on said rear end of said cable, (h) an exercise lever having front and rear end portions, and means pivotally mounting said rear end portion on said upright support frame to permit vertical swinging movement of said front end portion above said seat station, (i) resistive means connecting said exercise lever to said upright support frame to resist said swinging movement of said exercise lever, (j) a first crank member having at least one first rotary crank arm and a crank handle on said first crank arm, (k) first mounting means mounting said first crank member on said upright support frame above said seat station for longitudinal adjustable movement front-to-rear of said upright support frame, (l) a second crank member having at least one second rotary crank arm and a pedal mounted on said second crank arm for rotating said second crank arm, (m) second mounting means mounting said second crank member on said upright frame member behind and below said seat station and below said first mounting means for adjustable movement of said second crank member in a front-to-rear direction, (n) said cable handle, said front end portion of said exercise lever, and said crank handle being spaced from said seat station within reach of a hand of the person seated in said seat station, and said pedal being spaced from said seat station within the reach of a foot of the person seated in said seat station.

2. The invention according to claim 1 further comprising adjustable brake means mounted on each of said first and second crank members for resisting the rotation of said corresponding crank arms.

3. The invention according to claim 1 in which said pulley means comprises a front pulley and a rear pulley, said front pulley being mounted for free rotary movement about a transverse axis on said upright support frame above said seat station, said rear pulley being mounted for free rotary movement about a transverse axis on the upper rear portion of said upright support frame.

4. The invention according to claim 1 in which said upright support frame has a narrow transverse dimension relative to the upright and front-to-rear dimensions of said upright support frame, the transverse dimension of said seat station being substantially greater than and extending beyond the opposite sides of said upright support frame.

5. The invention according to claim 4 in which said upright support frame has a vertical central medial plane, said cable lying substantially in said medial plane, said exercise lever comprising a pair of exercise levers pivotally mounted on opposite sides of said medial plane, said first crank member having a pair of rotary crank arms on opposite sides of said medial plane and projecting in diametrically opposite directions from the rotary axis of said first crank member, said second crank member having a pair of rotary crank arms on opposite sides of said medial plane and extending in diametrically opposite directions from the rotary axis of said second crank member.

6. The invention according to claim 5 in which said front portion of said base frame comprising a pair of transversely spaced forward frame extension members projecting from the front portion of said upright support frame to define a space for receiving a seat member between said frame extension members and said front portion of said upright support frame in said seat station.

7. The invention according to claim 6 in which said seat member is a wheelchair.

8. The invention according to claim 6 in which said seat member includes a seat bracket, a seat mounted on said seat bracket, and means for detachably connecting said seat bracket to the front portion of said upright support frame, said seat member further comprising a pair of support legs connected to said seat bracket and projecting transversely outward and downward, terminating in lower support ends.

9. The invention according to claim 8 further comprising socket means in said frame extension members, each socket means receiving a corresponding support end of a support leg for said seat member.

10. The invention according to claim 1 in which said upright support frame comprises an upper section and a lower section and means for detachably connecting said upper section to said lower section.

11. The invention according to claim 1 in which said resistive means comprises an elongated fluid cylinder having a telescoping piston rod, means pivotally mounting said cylinder to said upright support frame and detachable means for adjustably mounting said piston rod at various spaced longitudinal positions along said exercise lever.

* * * * *